US007278339B2

(12) United States Patent
Hu

(10) Patent No.: US 7,278,339 B2
(45) Date of Patent: Oct. 9, 2007

(54) REVERSIBLE RATCHET WRENCH

(76) Inventor: Bobby Hu, 8F, No. 536-1, Ta Chin Street, Taichung (TW)

( * ) Notice: Subject to any disclaimer, the term of this patent is extended or adjusted under 35 U.S.C. 154(b) by 0 days.

(21) Appl. No.: 11/550,495

(22) Filed: Oct. 18, 2006

(65) Prior Publication Data

US 2007/0131064 A1 Jun. 14, 2007

(30) Foreign Application Priority Data

Dec. 8, 2005 (TW) ..... 94143445 A

(51) Int. Cl.
*B25B 13/46* (2006.01)
*B25B 13/00* (2006.01)
*B25B 17/00* (2006.01)

(52) U.S. Cl. ..... 81/63.2; 81/63

(58) Field of Classification Search ..... 81/61–63.2
See application file for complete search history.

(56) References Cited

U.S. PATENT DOCUMENTS 6,431,031 B1 8/2002 Hu
6,457,387 B1 * 10/2002 Hu ..... 81/63.2
6,568,299 B2 * 5/2003 Hu ..... 81/63.2
6,955,104 B2 * 10/2005 Hu ..... 81/63.2

* cited by examiner

*Primary Examiner*—David B Thomas
(74) *Attorney, Agent, or Firm*—Alan Kamrath; Kamrath & Associates PA

(57) ABSTRACT

A reversible ratchet wrench includes a handle from which a head extends. The head includes a compartment and a receiving hole in communication with the compartment. A drive member is rotatably mounted in the compartment and a pawl is slidably mounted in the compartment. A ring is mounted in the compartment and around an end of the drive member. A reversing plate is pivotably mounted to the end of the drive member and operatively connected to the ring to turn therewith. A switching member is pivotably mounted in the receiving hole of the head. The switching member is operatively connected to a tip piece of the ring to turn therewith. The switching member is operatively connected to the pawl to move the pawl for changing a driving rotating direction of the reversible ratchet wrench when the reversing plate is moved between two positions corresponding to two opposite driving rotating directions.

13 Claims, 9 Drawing Sheets

REVERSIBLE RATCHET WRENCH

BACKGROUND OF THE INVENTION

1. Field of the Invention

The present invention relates to a ratchet wrench and, more particularly, to a reversible ratchet wrench.

2. Description of the Related Art

U.S. Pat. No. 6,431,031 discloses a reversible ratcheting tool comprising a handle, a head on an end of the handle, a drive member, a pawl, a ring, and a reversing plate. A transmission member in the form of a spring is mounted between the reversing plate and the pawl to covert manual pivotal movement of the reversing plate into pivotal movement of the pawl. The ratcheting tool of this design has a smaller head while providing higher torque-bearing capacity. In practice, the transmission member deforms to an excessive extent and, thus, results in unreliable ratcheting-direction switching operation between the drive member and the pawl. As a result, the switching arrangement is liable to get stuck or fails to provide reliable switching. Further, the transmission member fatigues easily due to excessive deformation and/or twist under the action of shear forces from the pawl, the ring, the head, and the reversing plate, leading to malfunction of the ratcheting tool.

SUMMARY OF THE INVENTION

A reversible ratchet wrench in accordance with the present invention comprises a handle, a head extending from the handle, a drive member, a pawl, a ring, a reversing plate, and a switching member. The head includes a compartment and a receiving hole in communication with the compartment. The drive member is rotatably mounted in the compartment of the head and includes a first end and a second end for driving a fastener. The drive member further includes a plurality of teeth in an outer circumference thereof.

The pawl is slidably mounted in the compartment of the head. The pawl includes a toothed side with a plurality of teeth for engaging with the teeth of the drive member. The ring is mounted in the compartment of the head and around the first end of the drive member. The ring includes a tip piece. The reversing plate is pivotably mounted to the first end of the drive member. The reversing plate is operatively connected to the ring to turn therewith.

The switching member is pivotably mounted in the receiving hole of the head. The switching member is operatively connected to the tip piece of the ring to turn therewith. The switching member is operatively connected to the pawl to move the pawl for changing a driving rotating direction of the reversible ratchet wrench when the reversing plate is moved between two positions corresponding to two opposite driving rotating directions.

The pawl further includes a recessed portion in another side opposite to the toothed side of the pawl. The switching member further includes a receptacle in which an elastic element is mounted. The switching member further includes a pressing member mounted in the receptacle and biased by the elastic element to press against the recessed portion of the pawl.

Preferably, the pressing member is a hollow pin with a blind hole.

Preferably, the switching member further includes an engaging section engaged with the tip piece of the ring.

Preferably, the engaging section of the switching member includes a protrusion, and the tip piece of the ring includes a slot in which the protrusion is slidingly received.

Preferably, the switching member further includes a recessed portion adjacent to the engaging section.

Preferably, the switching member further includes two grooves respectively in two lateral sides thereof.

Preferably, the reversing plate includes a hole allowing the reversing plate to be mounted around the first end of the drive member that extends beyond the compartment of the head, and the reversing plate further includes a thumb piece for manual operation.

Preferably, the ring further includes a notch, and the reversing plate further includes a positioning piece extending into the notch of the ring to allow joint rotation of the reversing plate and the ring.

Preferably, the compartment of the head includes a first compartment section in which the drive member is received and a second compartment section in which the pawl is received.

Preferably, the thumb piece of the reversing plate further including an arcuate groove, and the head further includes a pin hole. A pin has a first end fixed in the pin hole of the head and a second end received in the arcuate groove of the reversing plate.

Preferably, the thumb piece further includes a receiving space in communication with the arcuate groove and defined by an end wall. A retaining means is mounted in the receiving space of the thumb piece for retaining the reversing plate in one of the positions.

Preferably, the retaining means includes a slide piece and an elastic element for biasing the slide piece to press against the pin.

Preferably, the slide piece is substantially U-shaped and has two limbs between which the elastic element of the retaining means is received. The elastic element of the retaining means has a first end abutting against the end wall of the thumb piece and a second end abutting against an intermediate portion of the U-shaped slide piece, thereby pressing the slide piece against the pin.

Other objectives, advantages, and features of the invention will become more apparent from the following detailed description when taken in conjunction with the accompanying drawings.

DETAILED DESCRIPTION OF THE PREFERRED EMBODIMENT

Figure 1:
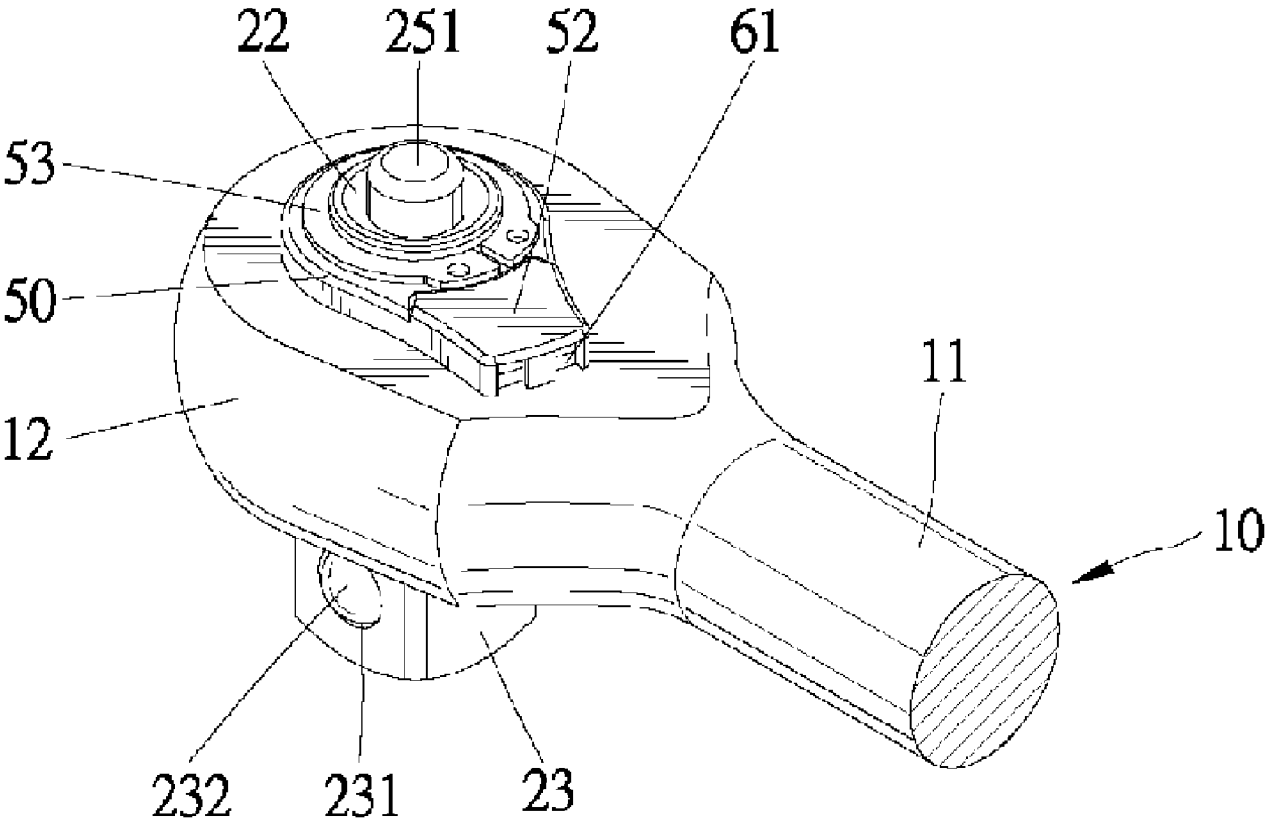
FIG. 1 is a perspective view of a portion of a reversible ratchet wrench in accordance with the present invention.
Figure 2:
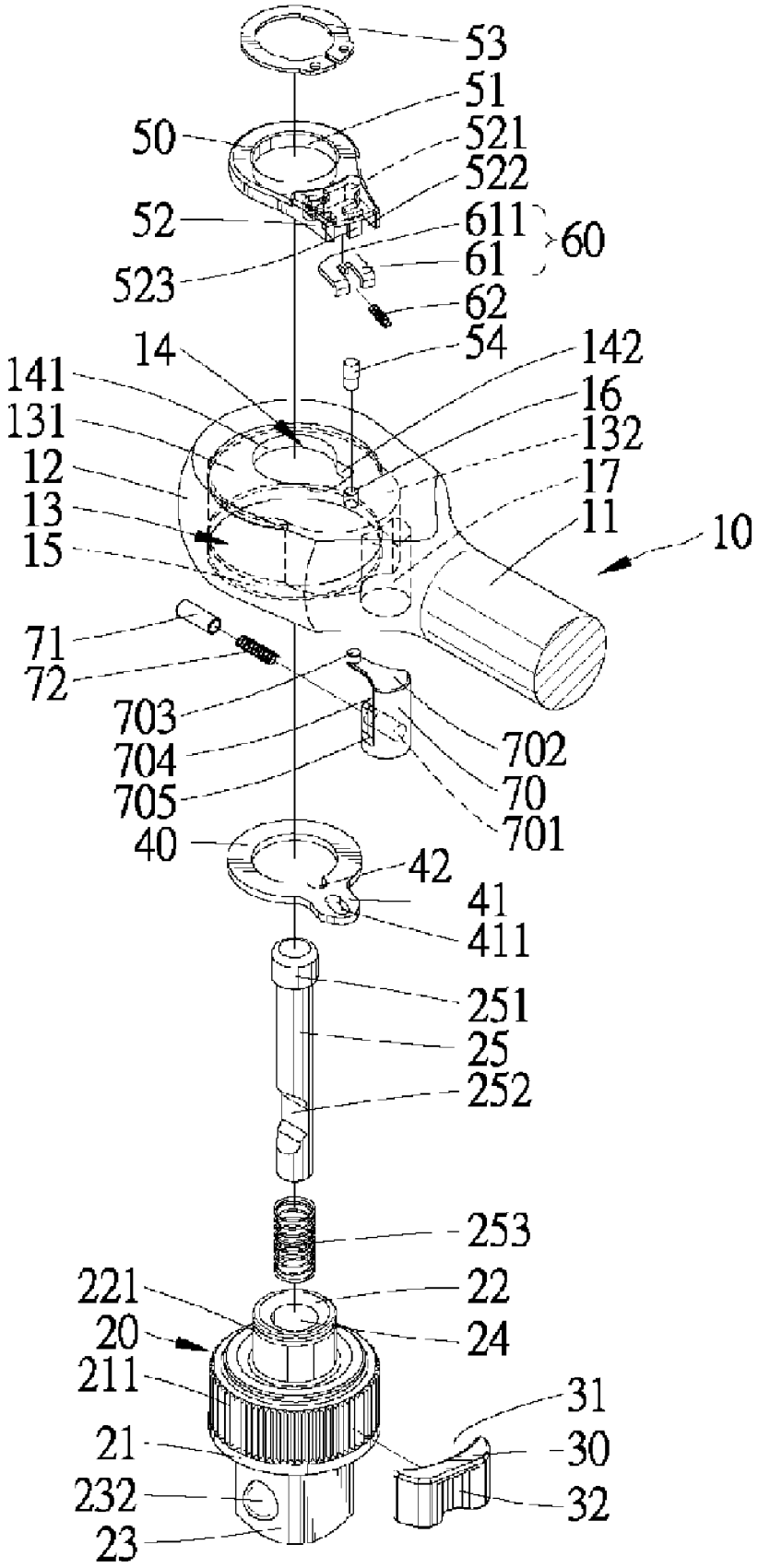
FIG. 2 is an exploded perspective view of the reversible ratchet wrench in accordance with the present invention.
Figure 3:
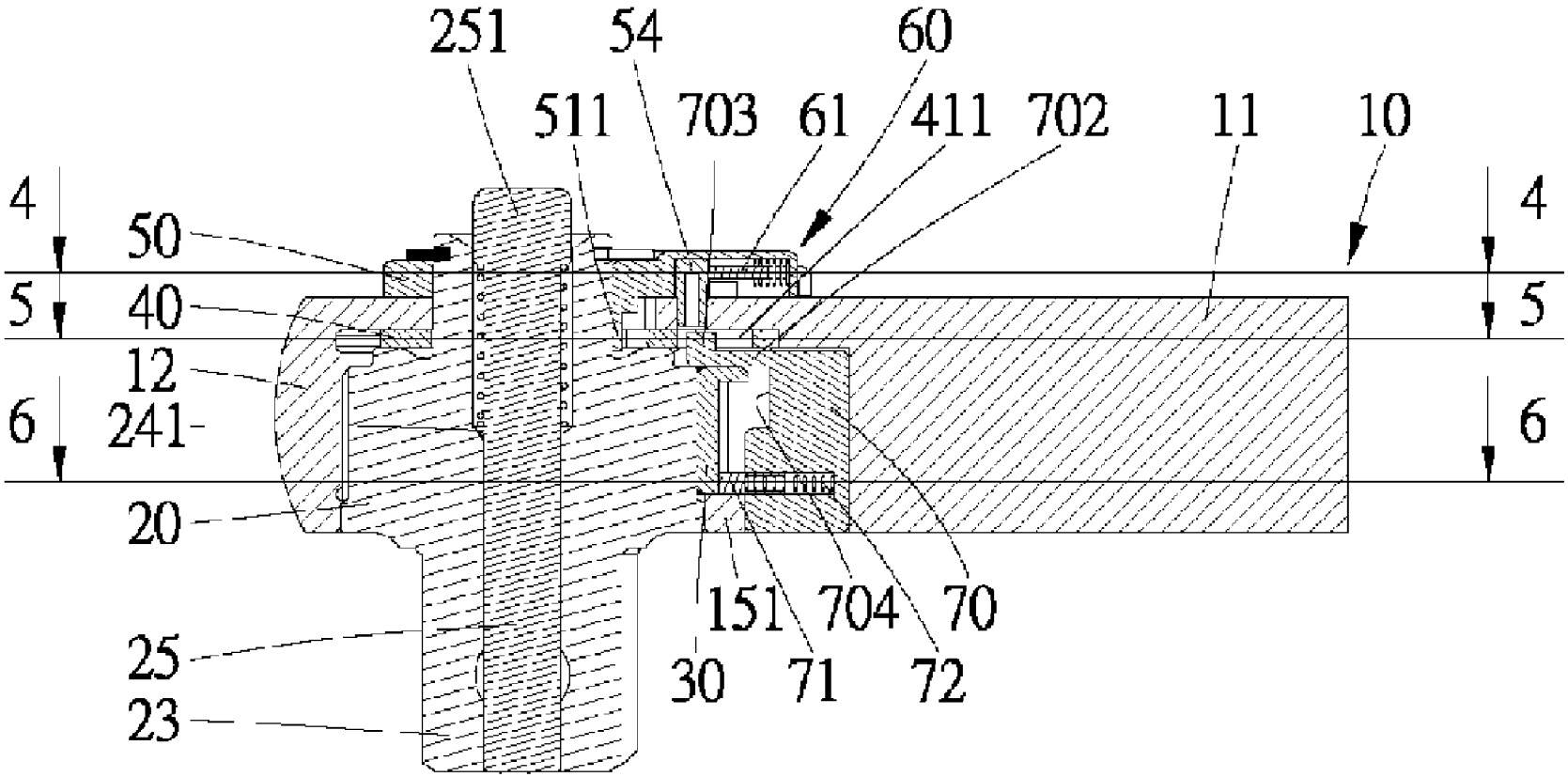
FIG. 3 is a sectional view of the reversible ratchet wrench in accordance with the present invention.

Referring to FIGS. 1 through 3, a reversible ratchet wrench 10 in accordance with the present invention comprises a handle 11 and a head 12 extending from an end of the handle 11. In this example, the head 12 is substantially circular and has a small volume. The head 12 includes a compartment 13 consisting of a larger, first compartment section 131 and a smaller, second compartment section 132. A top face (not labeled) of the head 12 includes an opening 14 consisting of a substantially circular opening section 141 that is concentric with the first compartment section 131 and a non-circular (substantially rectangular in this example) opening section 142. The top face of the head 12 further includes a pin hole 16 adjacent to the opening section 142. Defined in a bottom face of the head 12 is a circular hole 15 that is concentric with the first compartment section 131 and has a diameter the same as that of the first compartment section 131. Thus, the bottom face of the head 12 is formed with a stop 15 (FIG. 3) that defines a portion of the second compartment section 132. The bottom face of the head 12 further includes a receiving hole 17 that is adjacent to the circular hole 15 and that is in communication with the second compartment section 132. The receiving hole 17 is partially delimited by the stop 151.

Rotatably mounted in the larger, first compartment section 131 of the head 12 is a drive member 20 having a coupling section 21 in an intermediate portion thereof. The coupling section 21 is fittingly and rotatably received in the first compartment section 131 and includes a plurality of teeth 211 in an outer circumference thereof. Formed on an upper end (not labeled) above the coupling section 21 is an engaging portion 22 extending beyond the circular hole 141 of the head 12. An annular engaging groove 221 is defined in an outer circumference of the engaging portion 22. Formed on a lower end (not labeled) below the coupling section 21 is a drive column 23 including a hole 231 for receiving a ball 232. The drive member 20 further includes a central through-hole 24 extending from the engaging portion 22 through the drive column 23 and having a shoulder portion 241. The through-hole 24 of the drive member 20 is in communication with the hole 231 of the drive column 23, which will be described in detail later.

A pushpin 25 is mounted in the through-hole 24 of the drive member 20 and includes an enlarged upper end 251 for manual pressing. A lower end of the pushpin 25 includes a stepped groove 252 for receiving a portion of the ball 232 when the pushpin 25 is pushed, thereby allowing disengagement of the drive column 23 from a socket (not shown). An elastic member 253 is mounted around the pushpin 25 and attached between the shoulder portion 241 of the through-hole 24 and the enlarged end 251 of the pushpin 25. The elastic member 253 biases the pushpin 25 upward for moving the ball 232 outward to an engaging position for engaging with a socket, which is conventional and therefore not further described. The ball 232 is engaged with the stepped groove 252 to prevent disengagement of the pushpin 25.

A pawl 30 is mounted in the second compartment section 132 of the head 12 and includes a toothed side facing the teeth 211 of the drive member 20. The toothed side of the pawl 30 includes an arcuate surface 31 having a plurality of teeth 311 (preferably more than ten teeth) for engaging with the teeth 211 of the drive member 20, thereby providing reliable mesh therebetween. Thus, the pawl/drive member arrangement of the reversible ratchet wrench may bear higher torque. The pawl 30 includes a recessed portion 32 in another side facing away from the arcuate surface 31.

Still referring to FIGS. 1 through 3, a ring 40 is pivotally mounted around the engaging portion 22 of the drive member 20. A tip piece 41 projects outward from the ring 40 and includes a slot 411. A notch 42 is defined in an inner periphery of the ring 40 and aligned with the tip piece 41.

A reversing plate 50 includes a hole 51 so as to be mounted around the engaging portion 22 of the drive member 20. Hence, the reversing plate 50 and the drive member 20 have a common rotating axis. The reversing plate 50 further includes a thumb piece 52. The enlarged head 251 of the pushpin 25 extends through the circular opening section 141 of the head 12 and beyond the hole 51 of the reversing plate 50 for manual operation. A positioning piece 511 projects from the reversing plate 50 in a position adjacent to the thumb piece 52. A C-clip 53 is mounted around a portion of the engaging groove 221 of the engaging portion 22 of the drive member 20, thereby retaining the engaging portion 22 of the drive member 20 to the top face of the head 12. In addition, the positioning piece 511 is extended into the notch 42 of the ring 40 to allow joint turning of the reversing plate 50 and the ring 40. An arcuate groove 521 is defined in an underside of the thumb piece 52. The thumb piece 52 further includes a receiving space 522 in communication with the arcuate groove 521 and defined by an end wall 523. It is noted that the reversing plate 50 is securely yet pivotally engaged with the engaging portion 22 of the drive member 20.

A retaining means 60 is mounted in the receiving space 522 of the thumb piece 52 and includes a substantially U-shape slide piece 61 and an elastic member 62. The slide piece 61 includes a tapered push-face 611 consisting of two faces (not labeled) separated by a tip (not labeled, see FIG. 2). The elastic member 62 is received between two limbs (not labeled) of the U-shape slide piece 61. It is noted that an end of the elastic element 62 abuts against the end wall 523 of the thumb piece 52 and that the other end of the elastic element 62 abuts against an intermediate section (not labeled) between the limbs of the U-shaped slide piece 61. In practice, the end face defining the receiving space 522 is formed by pressing to provide a structure preventing disengagement of the elastic member 62 from the receiving space 522 yet allowing movement of the slide piece 61 relative to the elastic member 62.

A pin 54 has an upper end mounted in the arcuate groove 521 of the thumb piece 52 and a lower end fixed in the hole 16 of the head 12. The arcuate groove 521 is movable relative to the pin 54 during pivotal movement of the reversing plate 50. The push-face 611 of the slide piece 61 presses against the pin 54.

A switching member 70 is pivotably mounted in the receiving hole 17 of the head 12. The switching member 70 can be actuated by the ring 40 to control the position of the pawl 30. The switching member 70 includes a receptacle 701 in a front side facing the pawl 30. A pressing member 71 and an elastic element 72 are mounted in the receptacle 701, with the elastic element 72 biasing the pressing member 71 to press against the recessed portion 32 of the pawl 30.

Hence, when the switching member 70 pivots in the receiving hole 17, the pressing member 71 moves and, thus, changes the position of the pawl 30. In this example, the pressing member 71 is a hollow pin with a blind hole for receiving a portion of the elastic element 72.

The switching member 70 further includes an engaging section 702 extending in a radial direction of the circular opening 141 of the head 12 to the tip piece 41 of the ring 40. The engaging section 702 includes a protrusion 703 engaged in the slot 411 of the tip piece 41 such that the switching member 70 is pivoted when the ring 40 is turned. By such an arrangement, when the reversing plate 50 is pivoted, the switching member 70 is turned via transmission by the ring 40 such that the pawl 30 is moved by the pressing member 71.

The switching member 70 further includes a recessed portion 704 in the front side thereof in a position adjacent to the engaging section 702. The recessed portion 703 allows easy mounting of the switching member 70 into the receiving hole 17. More specifically, in assembly, since the receiving hole 17 is partially delimited by the stop 151, the switching member 70 is tilted to allow the engaging section 702 to enter the receiving hole 17, with the recessed portion 704 providing an evasive effect for the stop 151, and the switching member 17 is then completely inserted into the receiving hole 17. The switching member 70 further includes a groove 705 in each of two lateral sides thereof. The grooves 705 provide an evasive effect while moving the pawl 30, avoiding the switching member 70 and the pawl 30 from getting stuck (see FIG. 6).

Figure 4:
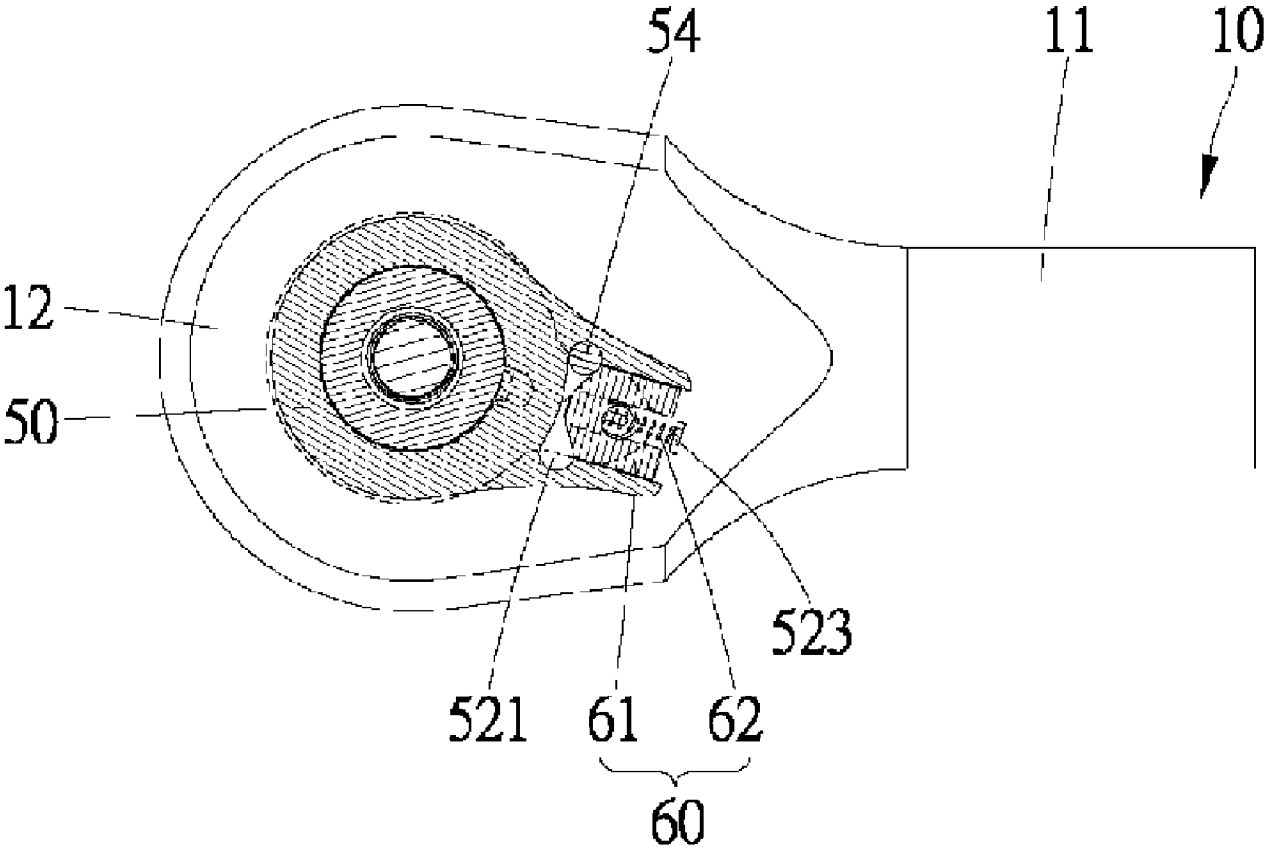
FIG. 4 is a sectional view taken along plane 4-4 in FIG. 3, wherein the wrench is in a state allowing counterclockwise driving rotation and clockwise free rotation.
Figure 5:
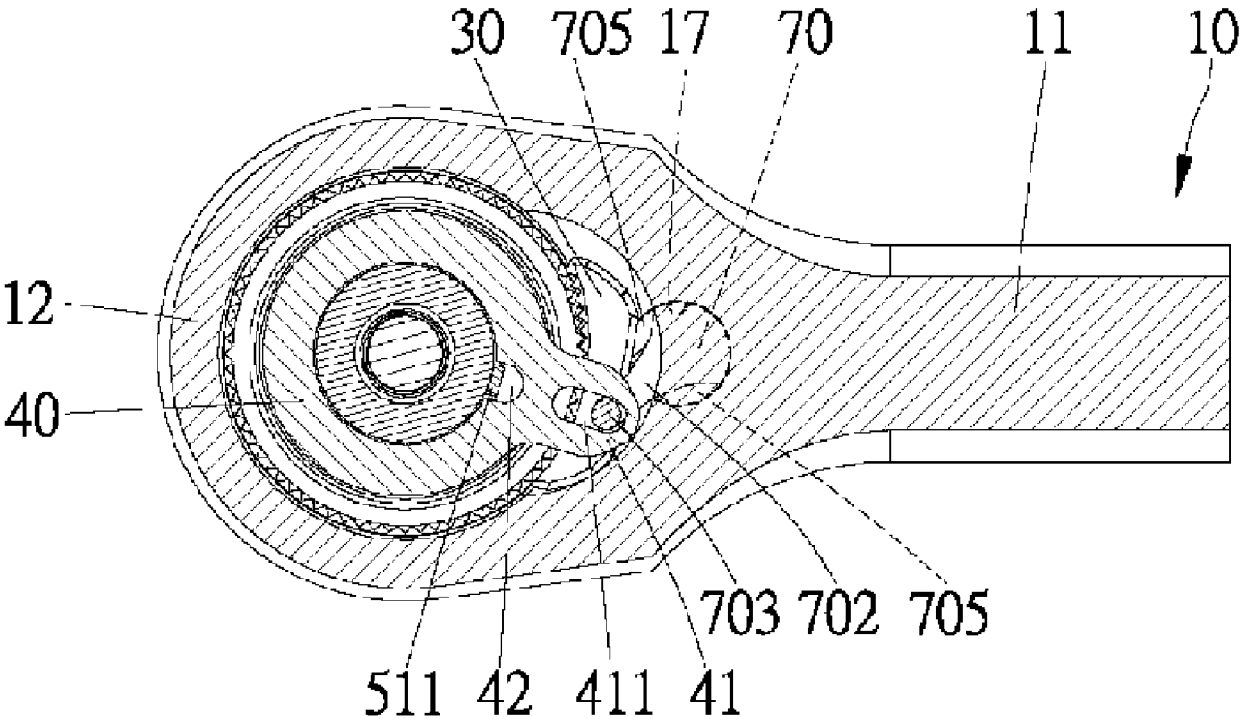
FIG. 5 is a sectional view taken along plane 5-5 in FIG. 3, wherein the wrench is in a state allowing counterclockwise driving rotation and clockwise free rotation.
Figure 6:
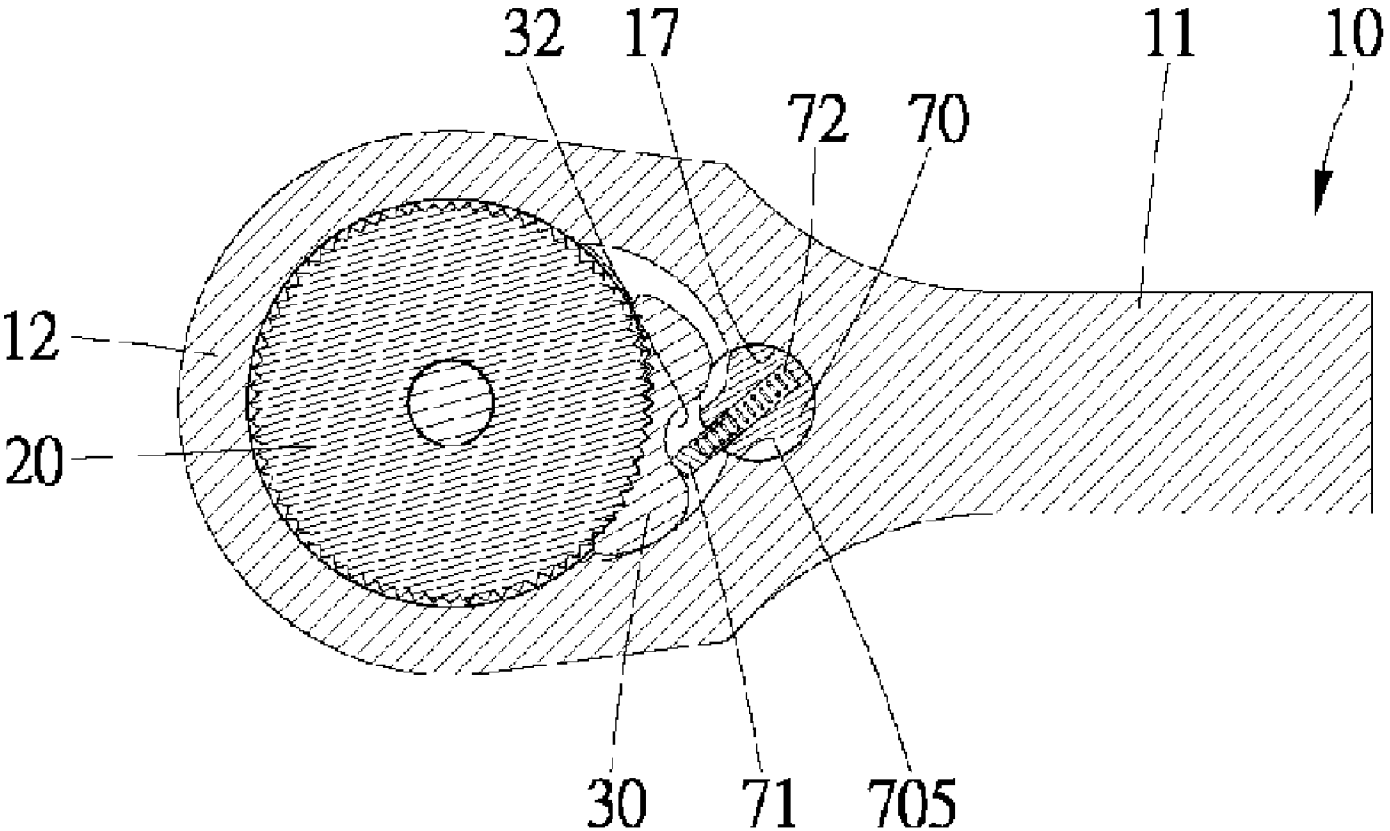
FIG. 6 is a sectional view taken along plane 6-6 in FIG. 3, wherein the wrench is in a state allowing counterclockwise driving rotation and clockwise free rotation.
Figure 8:
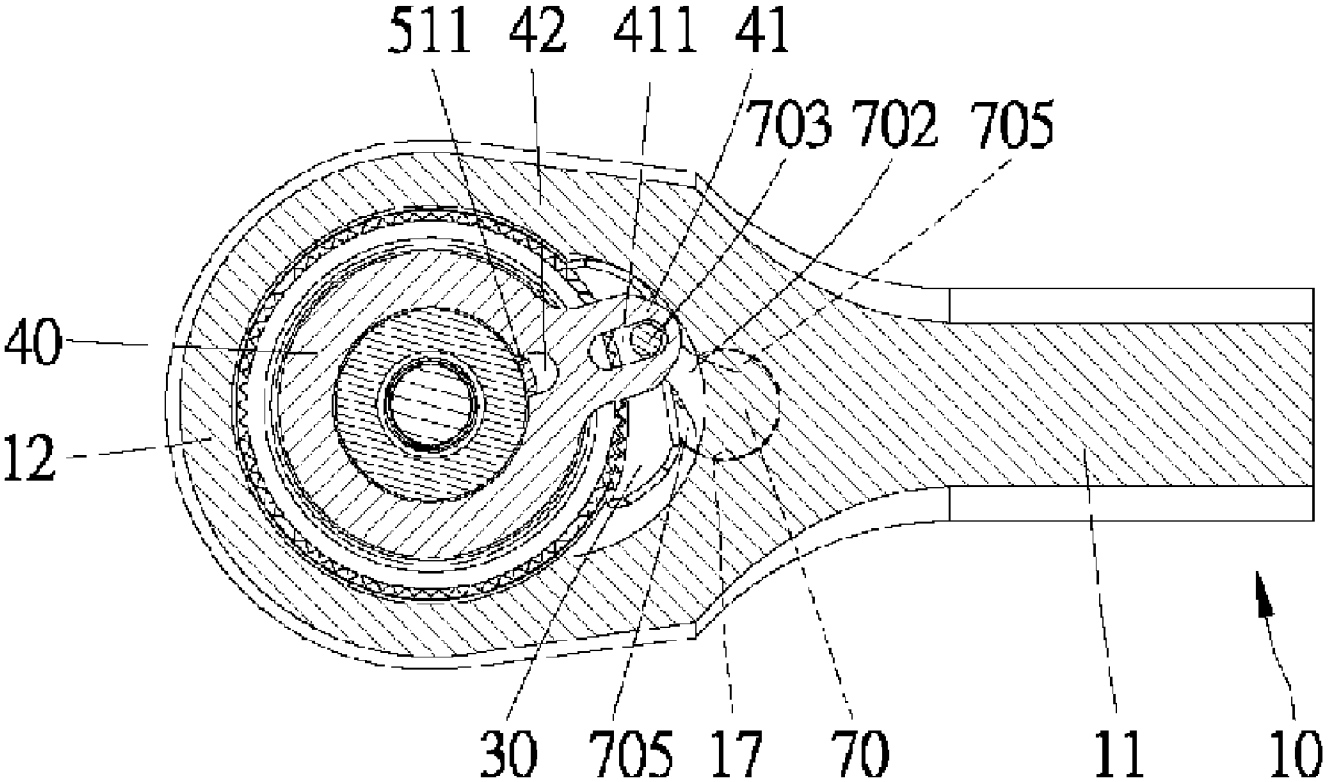
FIG. 8 is a sectional view similar to FIG. 5, wherein the wrench is in a state allowing clockwise driving rotation and counterclockwise free rotation.
Figure 9:
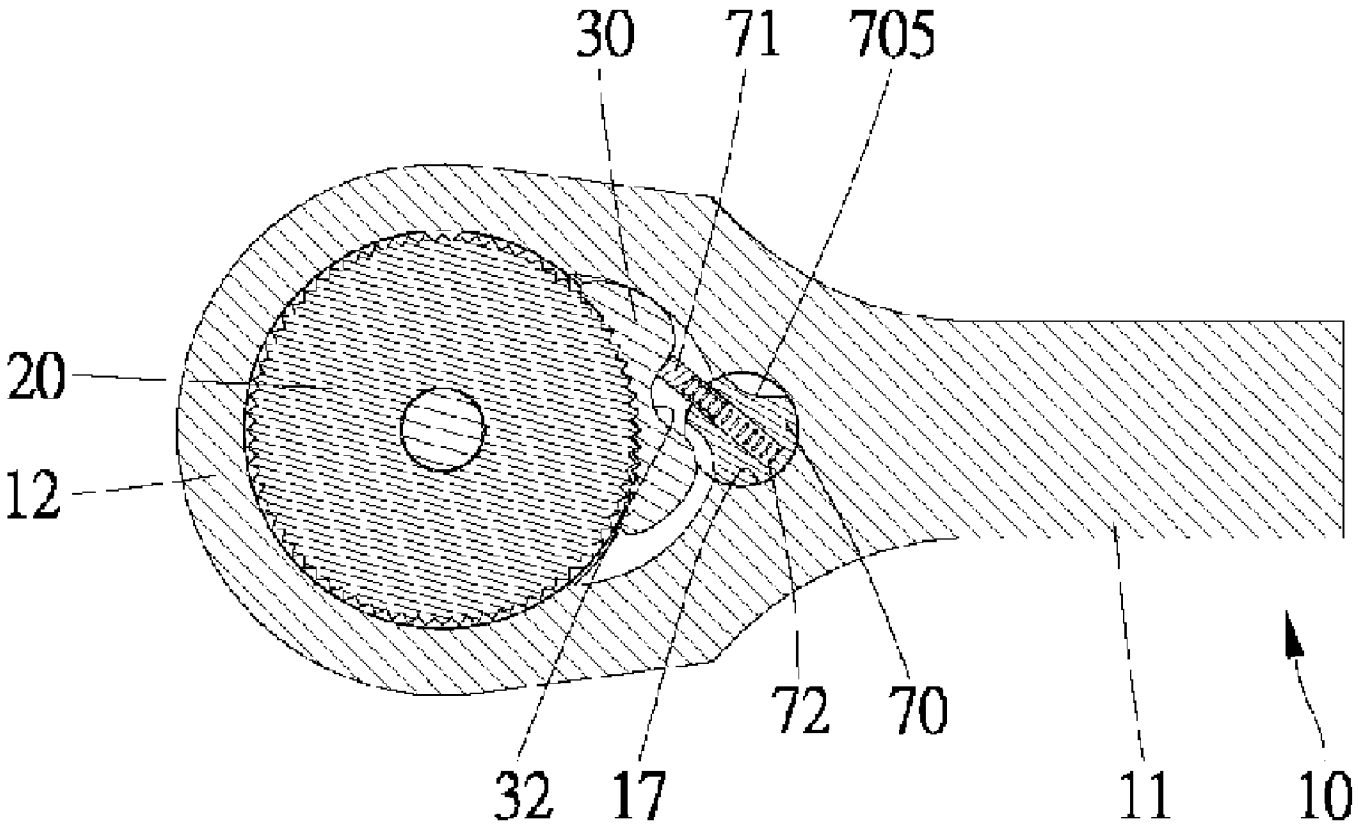
FIG. 9 is a sectional view similar to FIG. 6, wherein the wrench is in a state allowing clockwise driving rotation and counterclockwise free rotation.

When the wrench is in a position shown in FIGS. 4 through 6, the wrench allows counterclockwise driving rotation for driving a fastener and clockwise free rotation in which the fastener is not driven. When the wrench in a position shown in FIGS. 7 through 9, the wrench allows clockwise driving rotation for driving a fastener and counterclockwise free rotation in which the fastener is not driven.

Figure 7:
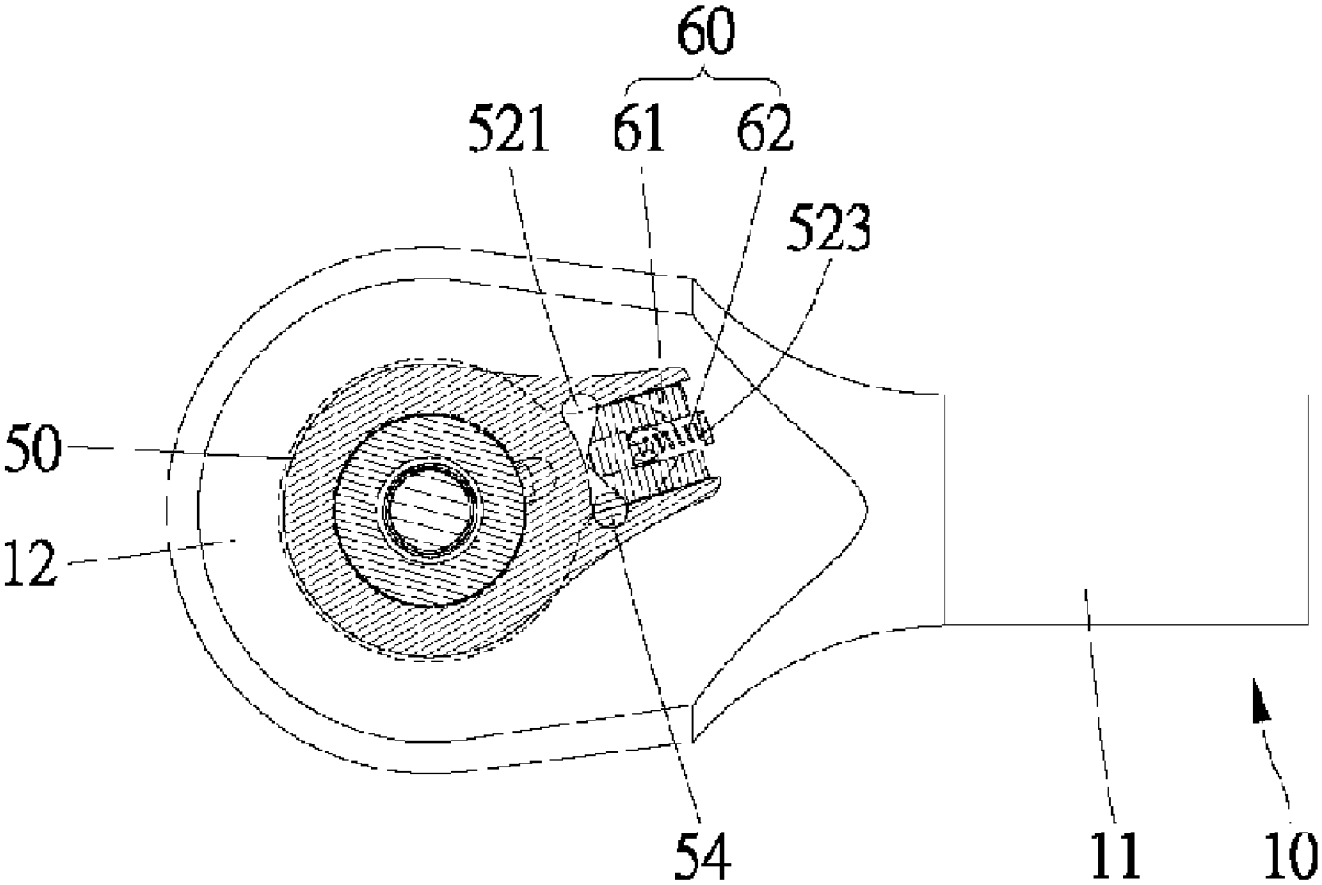
FIG. 7 is a sectional view similar to FIG. 4, wherein the wrench is in a state allowing clockwise driving rotation and counterclockwise free rotation.

When the reversing plate 50 is moved from the position shown in FIG. 4 to a position shown in FIG. 7, the pin 54 is moved to from an end to the other end of the arcuate groove 521. The slide piece 61 of the retaining means 60 is biased by the elastic element 62 against the pin 54 to reliably position the reversing plate 50. The positioning piece 511 of the reversing plate 50 is extended through the notch 42 of the ring 40, allowing joint turning of the reversing plate 50 and the ring 40, as mentioned above. The protrusion 703 of the switching member 70 slides in the slot 411 of the ring 40 during pivotal movement of the ring 40 whereas the engaging section 702 is driven by the tip piece 41 to turn the switching member 70 counterclockwise in the receiving hole 17. After pivoting, the pressing member 71 is biased by the elastic element 72 to press against the recessed portion 32 of the pawl 30, which, in turn, urges the teeth 31 of the pawl 30 to mesh with the teeth 211 of the drive member 20. It is noted that the grooves 705 of the switching member 705 provide an evasive effect, as mentioned above. Since the switching member 70 is rigid, a reliable, secure reversing effect is obtained without the risk of deformation or malfunction of the switching member 70 that pivots in the receiving hole 17. Namely, the malfunction risk is reduced whereas the qualified product rate is increased while providing a wrench with excellent quality and prolonged life.

Although a specific embodiment has been illustrated and described, numerous modifications and variations are still possible. The scope of the invention is limited by the accompanying claims.

What is claimed is:

1. A reversible ratchet wrench comprising:

a handle;

a head extending from the handle, the head including a compartment and a receiving hole in communication with the compartment;

a drive member rotatably mounted in the compartment of the head and including a first end and a second end for driving a fastener, the drive member further including a plurality of teeth in an outer circumference thereof;

a pawl slidably mounted in the compartment of the head, the pawl including a toothed side with a plurality of teeth for engaging with the teeth of the drive member;

a ring mounted in the compartment of the head and around the first end of the drive member, the ring including a tip piece;

a reversing plate pivotably mounted to the first end of the drive member, the reversing plate being operatively connected to the ring to turn therewith; and a switching member pivotably mounted in the receiving hole of the head, the switching member being operatively connected to the tip piece of the ring to turn therewith, the switching member being operatively connected to the pawl to move the pawl for changing a driving rotating direction of the reversible ratchet wrench when the reversing plate is moved between two positions corresponding to two opposite driving rotating directions;

the pawl further including a recessed portion in another side opposite to the toothed side of the pawl, with the switching member further including a receptacle, an elastic element being mounted in the receptacle, with the switching member further including a pressing member mounted in the receptacle and biased by the elastic element to press against the recessed portion of the pawl.

2. The reversible ratchet wrench as claimed in claim 1, with the pressing member being a hollow pin with a blind hole.

3. The reversible ratchet wrench as claimed in claim 1, with the switching member further including an engaging section engaged with the tip piece of the ring.

4. The reversible ratchet wrench as claimed in claim 3, with the engaging section of the switching member including a protrusion, and with the tip piece of the ring including a slot in which the protrusion is slidingly received.

5. The reversible ratchet wrench as claimed in claim 4, with the switching member further including a recessed portion adjacent to the engaging section.

6. The reversible ratchet wrench as claimed in claim 5, with the switching member further including two grooves respectively in two lateral sides thereof.

7. The reversible ratchet wrench as claimed in claim 3, with the reversing plate including a hole allowing the reversing plate to be mounted around the first end of the drive member that extends beyond the compartment of the head, and with the reversing plate further including a thumb piece for manual operation.

8. The reversible ratchet wrench as claimed in claim 7, with the ring further including a notch, and with the reversing plate further including a positioning piece extending into the notch of the ring to allow joint rotation of the reversing plate and the ring.

9. The reversible ratchet wrench as claimed in claim 1, with the compartment of the head including a first compartment section in which the drive member is received and a second compartment section in which the pawl is received.

10. The reversible ratchet wrench as claimed in claim 8, with the thumb piece of the reversing plate further including an arcuate groove, with the head further including a pin hole, and with the reversible ratchet wrench further including a pin having a first end fixed in the pin hole of the head and a second end received in the arcuate groove of the reversing plate.

11. The reversible ratchet wrench as claimed in claim 10, with the thumb piece further including a receiving space in communication with the arcuate groove and defined by an end wall, with the reversible ratchet wrench further including a retaining means mounted in the receiving space of the thumb piece for retaining the reversing plate in one of the positions.

12. The reversible ratchet wrench as claimed in claim 11, with the retaining means including a slide piece and an elastic element for biasing the slide piece to press against the pin.

13. The reversible ratchet wrench as claimed in claim 12, with the slide piece being substantially U-shaped and having two limbs between which the elastic element of the retaining means is received, and with the elastic element of the retaining means having a first end abutting against the end wall of the thumb piece and a second end abutting against an intermediate portion of the U-shaped slide piece, thereby pressing the slide piece against the pin.

* * * * *